United States Patent [19]

Grunewald

[11] Patent Number: 4,478,060

[45] Date of Patent: Oct. 23, 1984

[54] CONTINUOUS WASHING MACHINE

[75] Inventor: Heinz Grunewald, Bremen, Fed. Rep. of Germany

[73] Assignee: Engelhardt & Forster KG, Bremen, Fed. Rep. of Germany

[21] Appl. No.: 293,208

[22] PCT Filed: Dec. 6, 1980

[86] PCT No.: PCT/DE80/00183

§ 371 Date: Aug. 5, 1981

§ 102(e) Date: Aug. 5, 1981

[30] Foreign Application Priority Data

Dec. 7, 1979 [DE] Fed. Rep. of Germany ..... 2949228

[51] Int. Cl.[3] ..... D06F 31/00

[52] U.S. Cl. ..... 68/27; 68/58

[58] Field of Search ..... 68/27, 58

[56] References Cited

U.S. PATENT DOCUMENTS

| | | | |
|---|---|---|---|
| 2,700,287 | 1/1955 | Sulzmann | 68/27 |
| 3,145,554 | 8/1964 | Grimes | 68/27 X |
| 3,550,406 | 12/1970 | Jack, Jr. et al. | 68/58 |

FOREIGN PATENT DOCUMENTS

| | | | |
|---|---|---|---|
| 479594 | 7/1929 | Fed. Rep. of Germany | 68/58 |
| 1155416 | 10/1963 | Fed. Rep. of Germany | 68/27 |
| 820385 | 9/1959 | United Kingdom | 68/27 |

*Primary Examiner*—Philip R. Coe

*Attorney, Agent, or Firm*—Marshall, O'Toole, Gerstein, Murray & Bicknell

[57] ABSTRACT

The invention relates to apparatus for the simultaneous laundering of different laundry items, for example white and multicolored laundry batches, in a continuous washing machine, as well as a continuous washing machine appropriate therefor, comprising a washing drum whose washing compartments are separated from each other and are in each case connected to another washing compartment by a countercurrent conduit, whereby the countercurrent conduits (10) in each case are connected to a shut-off means (4) controllable with regard to their opening and closing condition, the washing compartments (23 C to K) moreover are connected in each case via a conduit section (10) having a controllable shut-off means (2) to a common connecting conduit section (12) which in each case are provided between two adjacent connecting conduits (11) with a correspondingly controllable shut-off means (3), and whereby a program-controlled control installation is present by means of which the shut-off means (2, 3, 4) are to be actuated in such a manner that the countercurrent liquid is to be guided at least around one washing compartment, without liquid entering another washing compartment from the by-passed washing compartment.

6 Claims, 29 Drawing Figures

CONTINUOUS WASHING MACHINE

Figure 1:
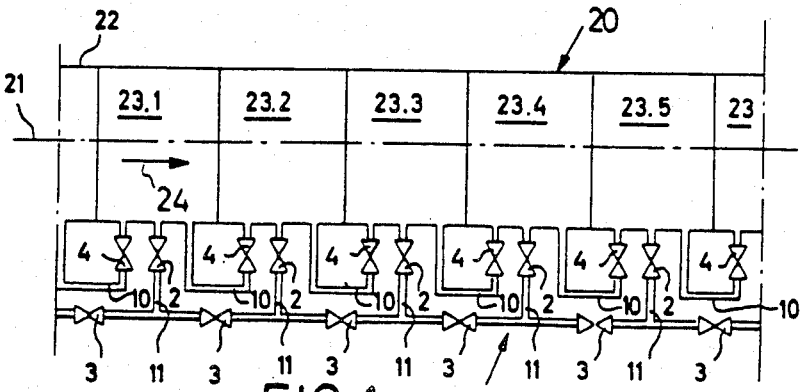

The invention relates to a method of simultaneously laundering different laundry items, consisting for example of either white laundry items or colored laundry items, in a continuous washing machine having a plurality of laundry zones, containing, if applicable, several laundry compartments, wherein the laundry items fed at the start of the laundering machine cyclically and consecutively in the area of the loading and/or soaking zone into the washing machine are transferred in each case, following a pre-determined treatment or a synchronized period of time, automatically into the next laundry compartment and delivered at the end of the washing machine cyclically and consecutively.

The invention moreover relates to a continuous washing machine appropriate and intended for carrying out the above-mentioned method for the washing of laundry, comprising a washing drum rotatable about its longitudinal axis, whose washing compartments, substantially separated from each other bathwise, are connected in each case to an adjacent laundry compartment by a countercurrent conduit, by means of which during the transportation of the laundry items from one laundry compartment to the next one, a partial current of the liquid in the laundry compartment located at the start of the drum end, is to be conducted in countercurrent to the laundry supplied batchwise and located at the start of the drum, traversing the laundry compartments cyclically and consecutively through the washing machine, said countercurrent consisting of a liquid fed via a feed current, and also comprising a soaking conduit through which the remainder of the fluid supplied at the drum end is to be conducted from the rinsing zone located at the drum end to the loading and soaking zone located at the start of the drum Basically two different methods are to be distinguished for the washing of laundry, namely on the one hand the multiple-lye method, wherein the laundry lye is exchanged at the end of the individual washing zones, that is to say, it is drained and replaced by new laundry lye, and on the other hand, the flow method, wherein the laundry to be washed is accompanied during its travel through the washing machine by the laundering lye.

Within the scope of the fluid flow method, the so-called countercurrent method is preferred for different reasons, whereby the washing zone (rinsing zone) located at the end of the washing machine is supplied via a feed conduit with fresh water which traverses the machine upon leaving the rinsing zone then with a partial current in counterflow to the laundry, while the preponderant residual current of the liquid fed at the end of the washing machine is supplied via a connection with the loading and soaking zone located at the start of the washing machine and designated here as a soaking conduit.

The countercurrent method is to be preferred over the other known washing methods, already for the reason that the water requirements percentagewise are lower (for example by 25%) against the quantity traversing the washing machine in countercurrent to the laundry. In addition, savings also are accomplished in detergents, detergent additives and last but not least also in energy needed for the heating up of the laundry lye by zones, so that continuous countercurrent washing machines have been making inroads to a considerable extent during the past years in the art.

Washing laundry in a countercurrent continuous washing machine is problem-free, as long as at the same time and always only laundry items of the same kind (that is for example only white laundry items) are in the washing machine; such laundry items not only are to be treated alike, but they cannot influence each other detrimentally. However, the latter may occur when laundry items of different types, that is for example laundry items consisting of what laundry on the one hand and colored laundry on the other hand are fed in random sequence into such a washing machine and thus are present also simultaneously in the washing machine. For under such conditions due to the discoloration of the colored laundry items, the washing lye adulterated with dye and/or discolored rinsing water may cause discoloration of the white laundry items during the embodiment of the countercurrent method desirable per se for reasons of economy.

In addition, in the above-mentioned example white laundry items are to be treated in certain laundering zones at higher temperatures than colored laundry items, so that such points of view are contrary in such cases for the embodiment of the countercurrent method.

The above are reasons why in laundries, where laundry material of different kinds are to be treated, for example, a smaller washing machine has been installed for the laundering of colored material, while a larger washing machine is used to launder white material.

However, already for reasons of economy, in view of the investments to be incurred therefor, such a method of operation is extremely unsatisfactory, so that the manufacturers of laundry machines have been endeavoring to design largescale washing machines for industrial laundries which can handle different types of laundry material simultaneously.

The washing machines quasi developed back out of countercurrent continuous washing machines again operate according to the old principle of the multi-lye method, discarded as such for reasons of economy, whereby these apparently inevitable disadvantages have been accepted, in order to avoid for these industrial laundries the investments otherwise necessary for a second washing machine.

The present invention is based on the problem of creating a laundering apparatus of the initially described kind, by which the washing operation can be performed substantially more economically as compared with the known appratus for the simultaneous laundering of laundry items of diverse kinds, by saving water, detergents, laundry aids, as well as energy.

In addition, the objective of the present invention is to create a continuous washing machine of the initially described kind, which in addition is appropriate for washing laundry items of the same kind, in order to launder them in a manner known from prior art per se, according to the economical countercurrent method.

The invention provides as a solution of the problem that laundry items of a preponderantly present first kind (that is white laundry) are laundered in a manner known per se according to prior art, under the countercurrent method, and that laundry items simultaneously present in the washing machine, of a second kind present in a lesser amount (for example multicolored laundry items or woolen fabrics) are laundered in a manner known per se according to prior art under the multi-lye method, whereby the partial current flowing in countercurrent to the laundry is fed from a laundry compartment containing laundry of the first kind and transported, bypassing a laundry compartment containing laundry of the second kind, to the next laundry compartment located in the direction of the countercurrent and containing laundry of the first kind.

It shall be pointed out here once more that, as known, under the countercurrent method a partial current of the washing fluid introduced at the end of the laundry machine traverses the laundry machine in countercurrent to the laundry, cyclically from one laundry compartment to the next one, while under the multi-lye method, the laundering lye is drained completely at the end of one washing zone and replaced by fresh laundry fluid.

With the embodiment of the washing apparatus according to the invention, it becomes possible to not only dispense with the investment for an additional, generally smaller washing machine for laundering laundry present to a lesser amount (multicolored laundry items for instance), but in addition the advantage is achieved that with laundry present in a larger amount, of the first kind (that is white laundry, for example) and/or maintained, offered by the countercurrent method, and while dispensing with a second washing machine, the disadvantages of a multi-lye method must not be accepted, as it is put into practice merely with laundry of the second kind present to a lesser amount.

As demonstrated already by the redevelopment of countercurrent continuous washing machines, modern per se, into multi-lye washing machines, a simultaneous laundering of laundry batches of different types, while practicing the countercurrent procedure universally recognized as advantageous has been considered until now as impossible and as a kind of self contradiction, because understandably, the starting point has been that the partial current conducted in countercurrent to the laundry through the washing machine, of the washing liquid introduced at the end of the washing machine into its rinsing zone erroneously and positively, for example in the case of white and colored items, would have to lead to discoloration of the white items and to improper treatment of the colored items because of too high temperatures. This age-old prejudice of the art present by nature and already contained in the definition consequently has been overcome according to the invention by creating a quasi "wandering by-pass" conduit adjustable to the prevailing momentary conditions, whereby, depending on actual situations, one or several washing compartments are by-passed by the partial flow of washing lye moving in countercurrent to the laundry, then the countercurrent principle is continued, while maintaining the aforementioned advantages, following said by-pass, as will be explained below.

The part of the problem directed toward the washing machine is solved according to the invention by providing the countercurrent conduits in each case with a shut-off means which here can be selectively opened and closed, and that the washing compartments moreover are connected via a conduit section having a controllable shut-off means to a joint connective conduit which in each case between two adjacent washing compartments is provided with a controllable shut-off means.

The present invention is applicable particularly to so-called double drum washing machines where the washing compartments of the washing drum located on the interior side are connected between the area located between the washing drum and the stationary outer drum by way of passage apertures, whereby said areas associated with the individual washing compartments are sealed against each other at least substantially because in the case of double drum continuous washing machines the arrangement and design of the individual conduits according to the invention can be realized in a particularly simple and expedient manner. However, as a matter of principle it also can be realized in so-called single drum machines if based on their design the arrangement of the various conduits according to the invention is feasible as this is the case for example in a known single drum machine where lip seals are present between two adjacent washing compartments, where stationary conduit ends are to be introduced between them also under the rotation of the drum.

Preferred embodiments of the present invention are described in the dependent claims.

Below the invention is elucidated in greater detail by way of embodiments, with reference to a drawing.

FIG. 1 represents a schematic representation of the central part of a continuous washing machine according to the invention, whereby for the clarification of the principle according to the invention only the conduits and conduit sections along with the shut-off means are illustrated.

Figure 1A:
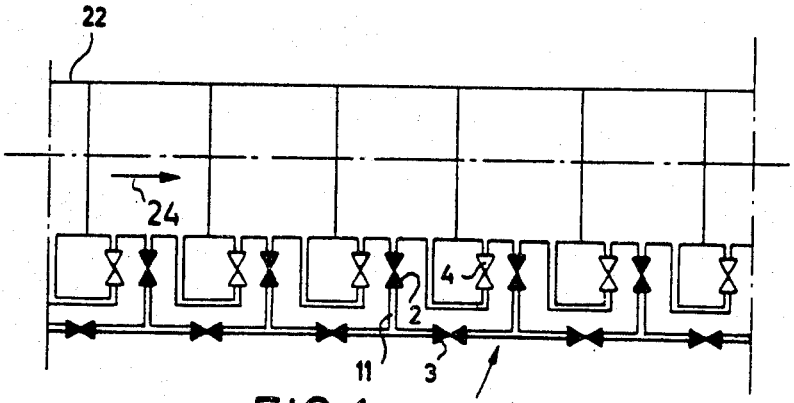

FIG. 1*a* shows a presentation corresponding to FIG. 1 for pure countercurrent operation whereby in each case in the individual washing equivalent batches of laundry consisting of white laundry are present.

Figure 1B:
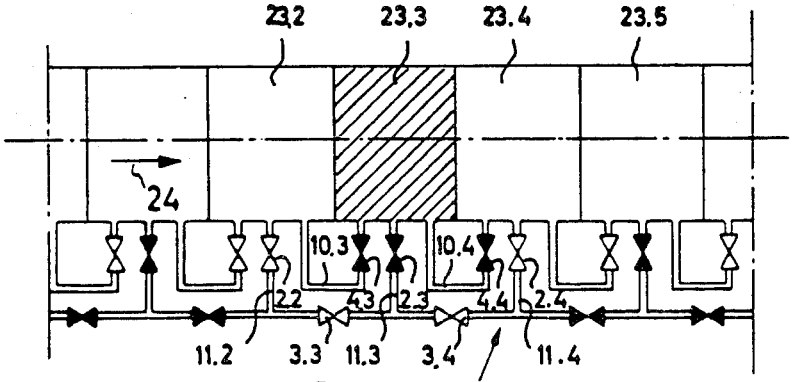

FIG. 1*b* shows a presentation corresponding to FIG. 1 whereby multicolored laundry material is present in a laundry compartment represented in broken lines, while the remaining laundry compartments contain white laundry items.

Figure 2:
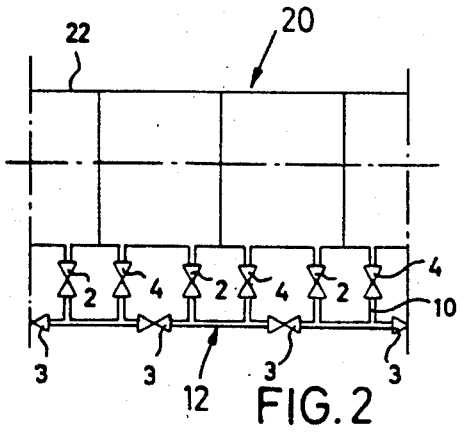

FIG. 2 shows a variation corresponding with respect to the representation to FIG. 1.

Figure 2A:
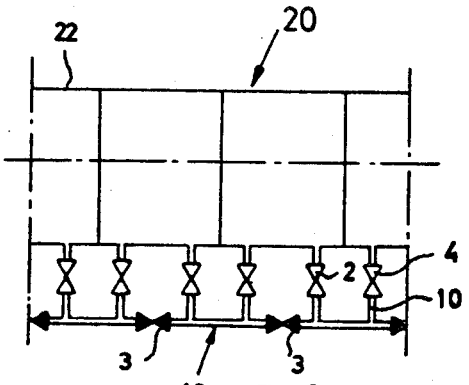

FIG. 2*a* shows a presentation corresponding to FIG. 2 with a laundering condition corresponding to FIG. 1*a*.

Figure 2B:
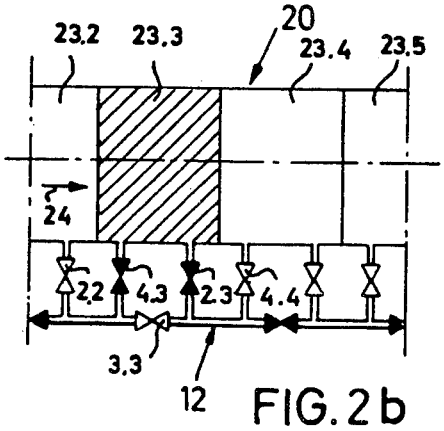

FIG. 2*b* shows a presentation corresponding to FIG. 2 with a laundering condition corresponding to FIG. 1*b*.

Figure 3:
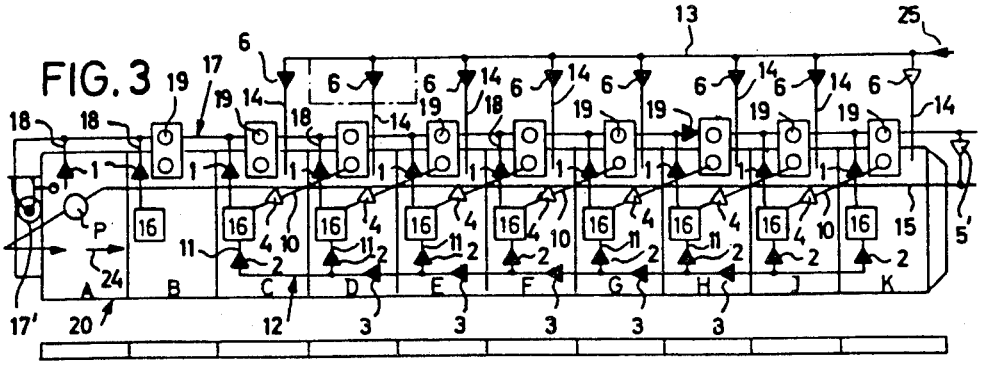
Figure 3A:
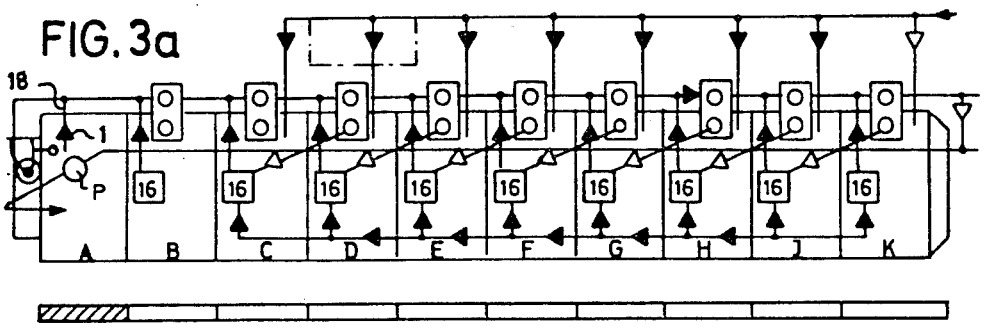
Figure 3B:
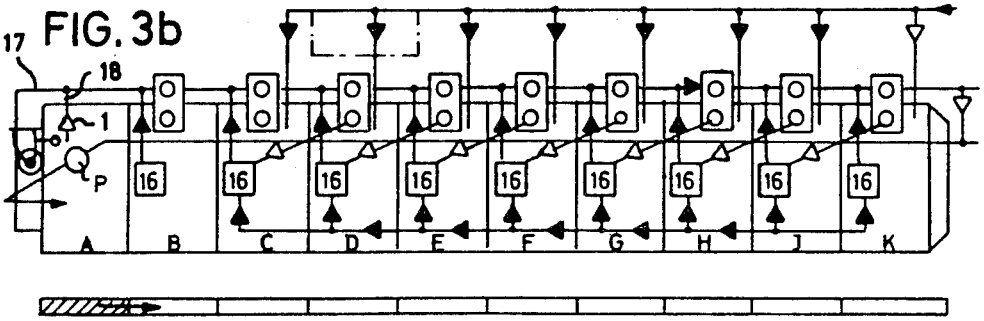
Figure 3C:
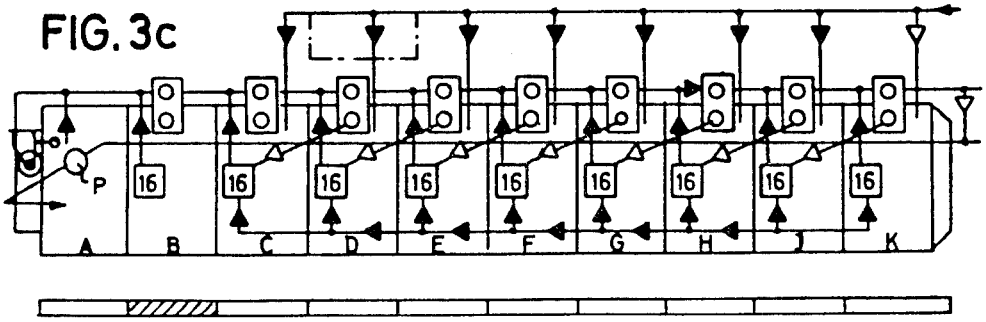
Figure 3D:
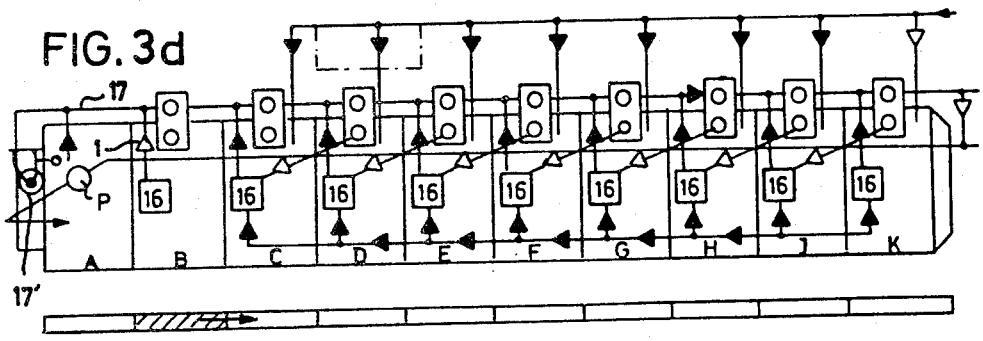
Figure 3E:
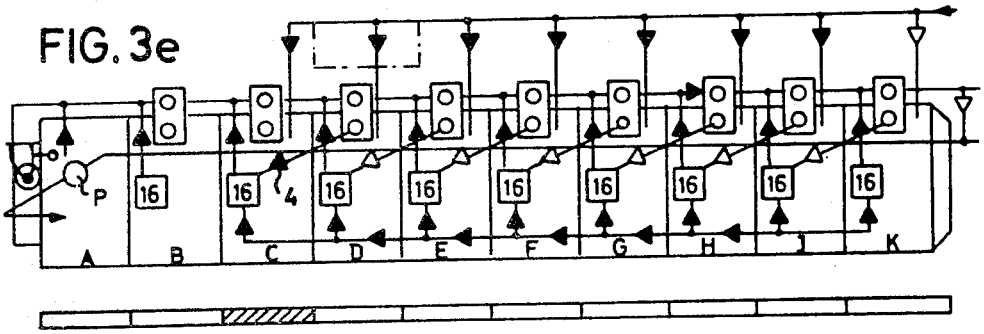
Figure 3F:
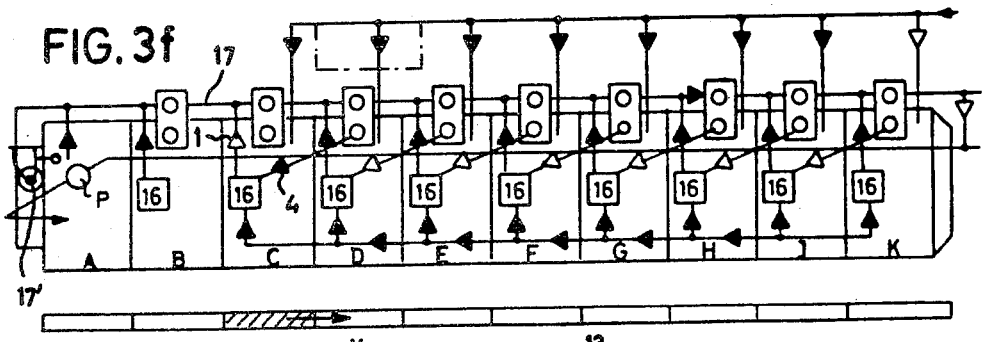
Figure 3G:
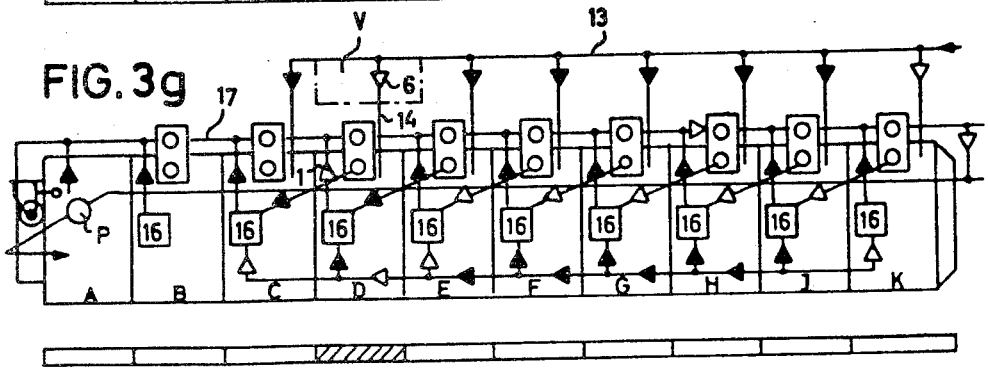
Figure 3H:
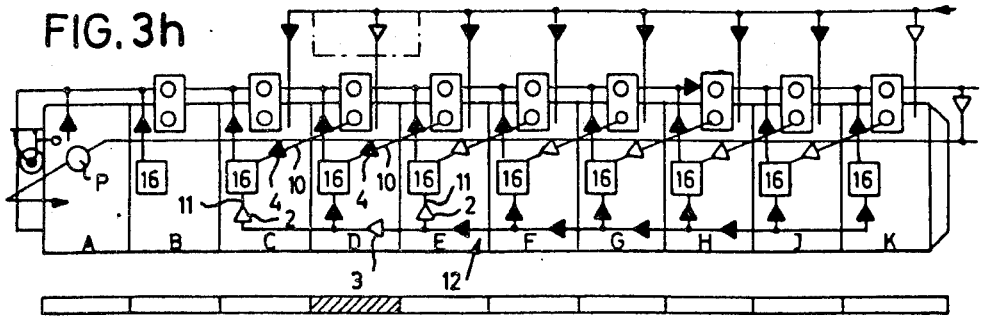
Figure 3I:
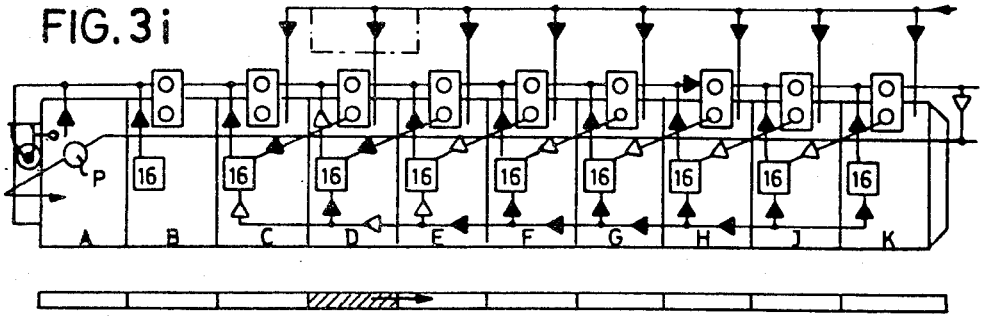
Figure 3K:
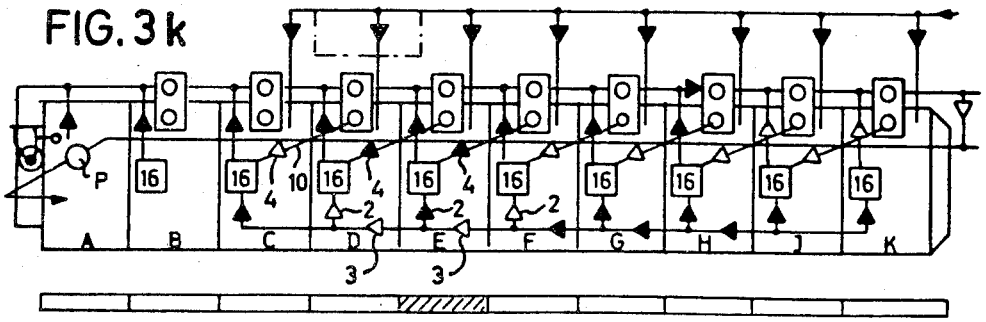
Figure 3L:
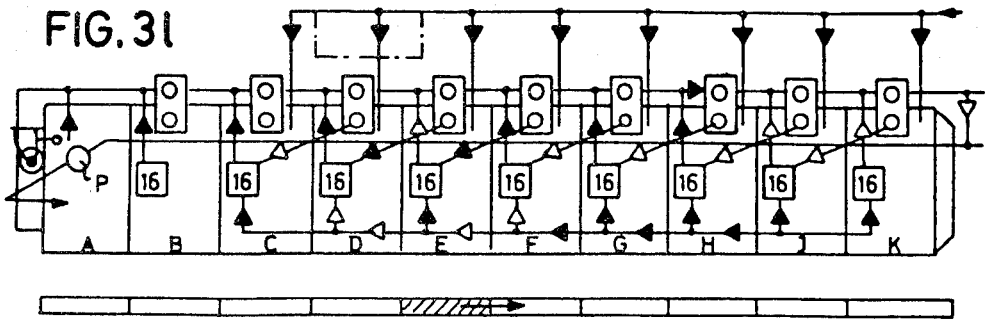
Figure 3M:
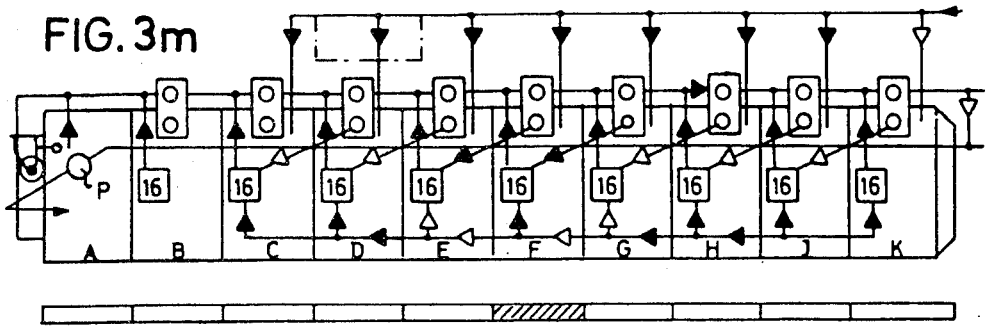
Figure 3N:
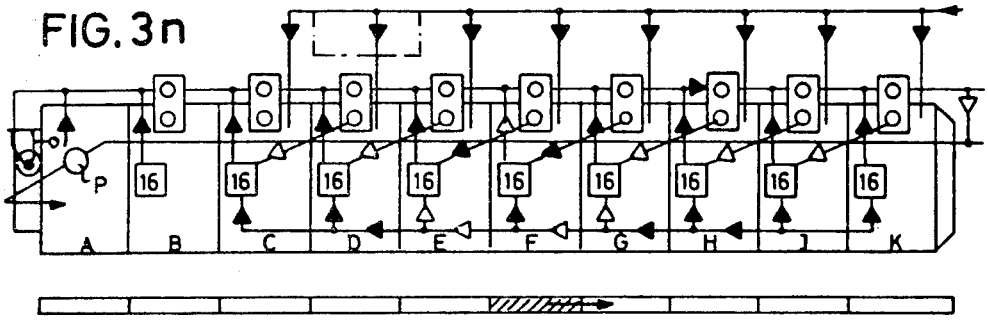
Figure 3O:
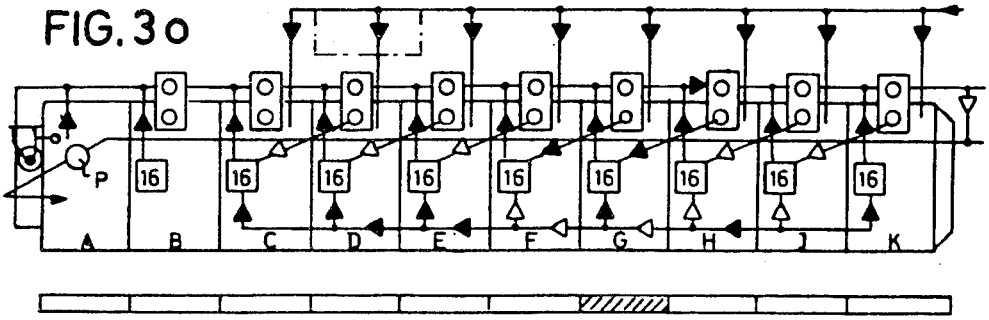
Figure 3P:
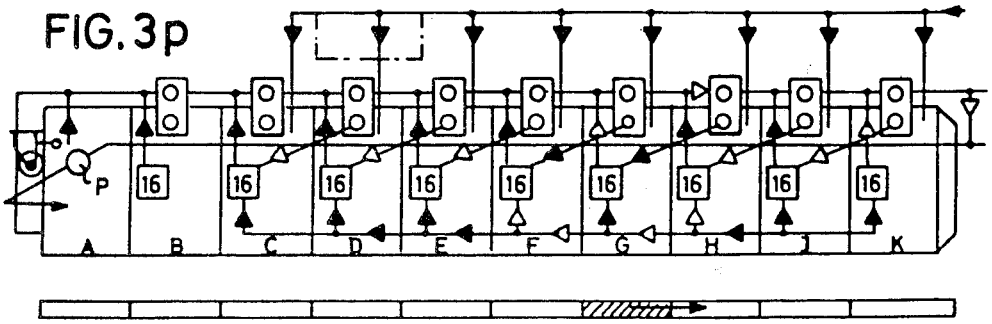
Figure 3Q:
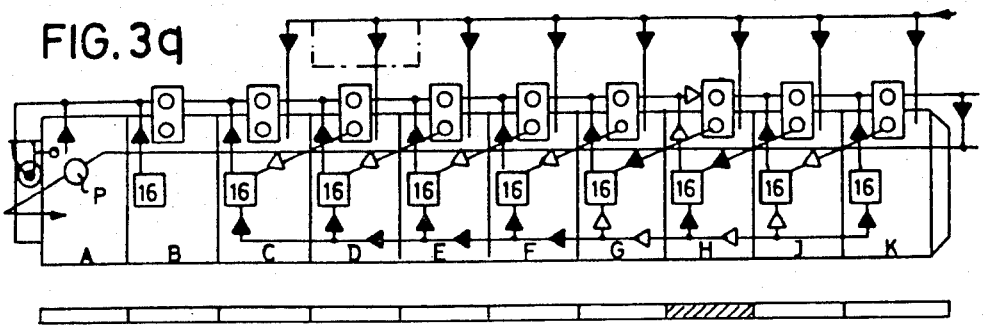
Figure 3R:
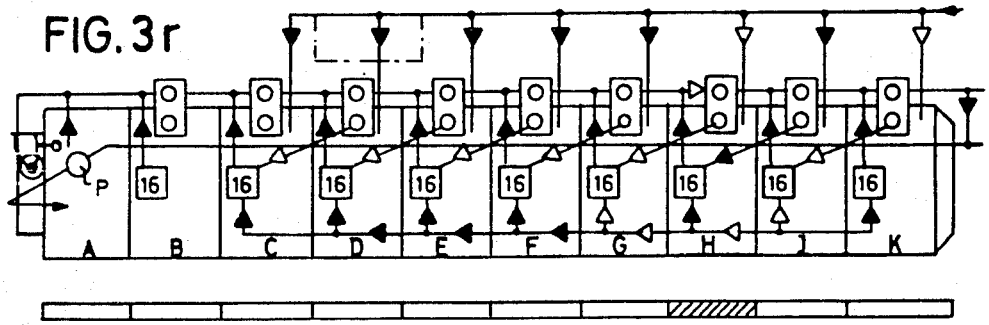
Figure 3S:
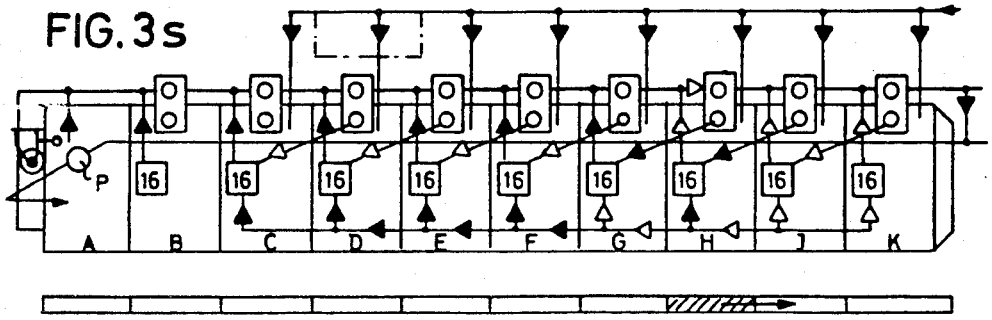
Figure 3T:
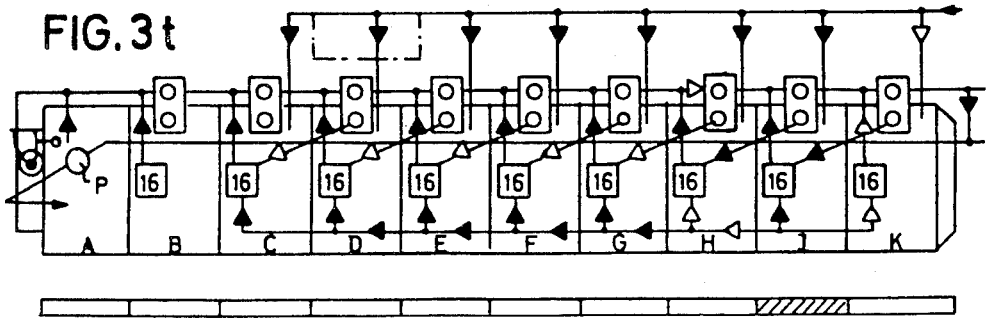
Figure 3U:
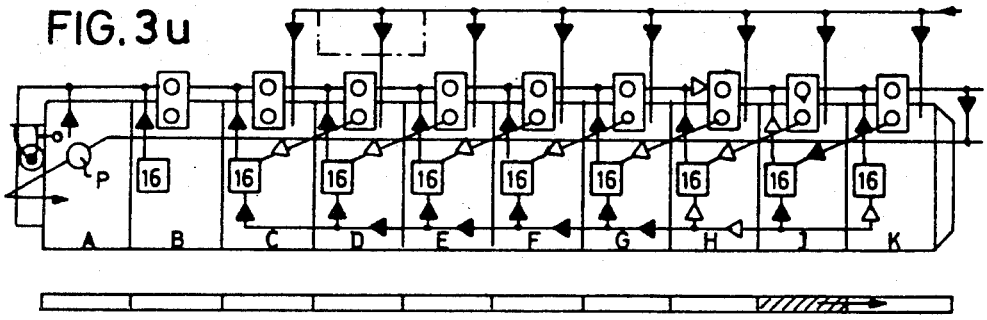
Figure 3V:
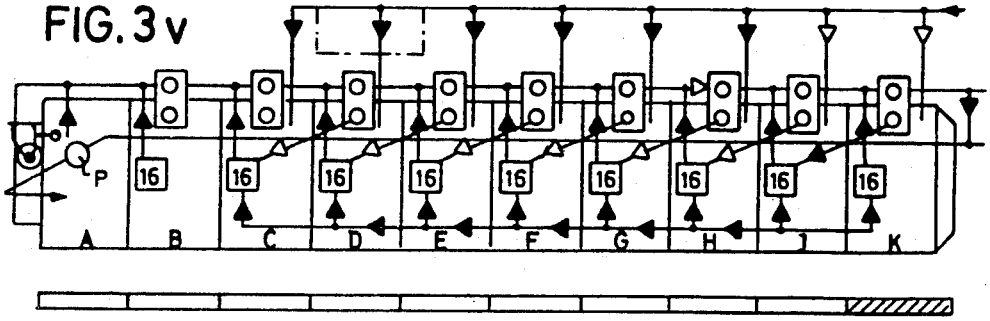
Figure 3W:
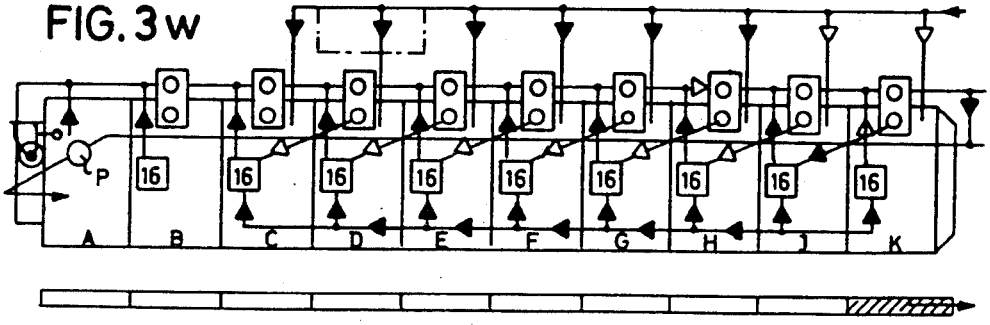

FIG. 3 shows a schematic representation of the conduit circuit diagram completed with regard to FIG. 1, of a double drum continuous washing machine according to the invention, and FIGS. 3*a* to 3*w* constitute representations according to FIG. 3 with the passage of a batch of laundry consisting of multicolored laundry items through the washing machine containing white laundry material for the remainder.

FIG. 1 shows a highly schematized representation of a central portion of a continuous washing machine for the itemwise washing of laundry, in fact in the kind of a circuit diagram relating to the conduits most essential for the invention with additional, present conduits are deleted for better clarification. They will be explained below in conjunction with FIG. 3.

The washing machine identified as a whole by 20 has a washing drum 22 rotatable about its longitudinal axis 21, whereby it is optional and therefore for the time being the question is left open whether this relates to a single or a double drum machine.

The washing drum 22 is provided with a series of washing compartments 23 which during the laundering operation are separated bathwise from each other, whereby FIG. 1 only shows part of said washing compartments 23, which for the sake of greater clarity are partly provided with ordinal numbers 0.1, 0.2, etc.

Two adjacent washing compartments 23 in each case are interconnected by a countercurrent conduit 10, through which, upon completion of one washing cycle, during the conveyance of the laundry items in the direction of the arrow 24 from one washing compartment into the following one, a partial current of the liquid furnished at the drum end not shown to the washing compartment located there, associated with the rinsing zone is to be furnished via a feed conduit not represented in FIG. 1 (explained below with reference to FIG. 3) and to be transferred in countercurrent to the laundry-that is opposite to arrow 24, into the following washing compartment. The countercurrent conduits 10 are provided in each case with a shut-off means to be selectively opened or closed by way of a programmed control installation.

Furthermore, the washing machine 20 is equipped with a soaking conduit likewise not shown and explained below with reference to FIG. 3. The remainder of the liquid fed at the drum end in the rinsing zone not flowing as partial current in countercurrent to the laundry through the machine, is directed from the rinsing zone directly to the loading and soaking zone located at the start of the drum.

Furthermore, the washing compartments 23 are connected in each case via a conduit section 11 to a joint connecting conduit 12, whereby likewise between the drum 22 and the connecting conduit 12 in the conduit sections 11 a shut-off means 2 again is arranged in each case which can be controlled by the mentioned control installation, that is to say it can selectively be opened or closed.

Moreover, in each case a shut-off means 3 which can be selectively opened or closed and controlled by means of the mentioned control installation is present between two adjacent washing compartments 23 and/or the junction points of the conduit sections 11 into the connecting conduit 12.

If for example the washing compartments 23 only contain laundry items consisting only of white goods for example, the washing machine 20 operates according to the normal countercurrent principle. Thus the washing drum 22 is propelled during a washing cycle in reverse and completes an oscillating swivel movement (for example by 90° or 180°) about its longitudinal axis 21. Following the completion of the washing cycle the washing drum then completes an entire revolution whereby a laundry item present in each case in a washing compartment 23 is conveyed along with the essential portion of the washing fluid present in this washing compartment 23 in the direction of the arrow 23 into the adjacent washing compartment 23. This may be accomplished for example by means of a conveyor installation designed as a spiral chute or the like. At the same time part of the washing lye located in this subsequent washing compartment 23 flows via the countercurrent conduit 10 connecting these two washing compartments in the direction opposite to the arrow 23 into the adjacent washing compartment and so forth.

As shown in FIG. 1*a*, thereby the shut-off means 4 present in the countercurrent conduits 10 are opened and the shut-off means 3 present in the connecting conduit 12 as well as the shut-off means 2 present in the conduit sections 11 are closed, with a closed state of the shut-off means being indicated in the drawing by the fact that they are shown in black in each case, while open shut-off means merely are shown by thin lines. Under normal countercurrent operation with laundry of the same kind it would thus be possible to dispense with the conduits 11 and 12 and with the shut-off means 2 and 3, as this also is known from the countercurrent washing machines according to prior art.

If, conversely, one washing compartment—according to FIG. 1*b* for example the washing compartment 23.3—contains laundry of a second kind, actually in the present example, multicolored laundry, it is impossible to maintain in the area of this washing compartment 23.3 the normal countercurrent operation, as this would lead, among other things, to a discoloration of the white laundry material in washing compartment 23.2.

Accordingly, as shown in FIG. 1*b*, under this load condition the shut-off means 4.3 associated with the washing compartment 23.3 is closed in the countercurrent conduit 10.3. In addition the shut-off means 4.4 in the countercurrent conduit 10.4 connecting the washing compartment 23.4 with the washing compartment 23.3 is closed, and in addition the shut-off means 2.3 located in the conduit section 11.3 is closed, so that the washing compartment 23.3 containing the colored laundry material thus is quasi encapsulated against its environment. Thus it neither can influence it nor be influenced by it.

To be able to maintain the countercurrent operation and the advantages connected therewith for the remainder, the shut-off means 2.4 in the conduit section 11.4 as well as the shut-off means 2.2 in the conduit section 11.2 are opened. Furthermore the shut-off means 3.3 and 3.4 located between the conduit sections 11.2 and 11.4 are opened, so that the countercurrent liquid can discharge from the washing compartment 23.4, hence by-passing the washing compartment 23.3, via the line section 11.4, via a section of the connecting conduit 12 containing the shut-off means 3.4 and 3.3 and via the conduit section 11.2 into the next compartment 23.3 containing the white wash, from where the normal countercurrent operation then continues analogous with FIG. 1*a*. The same applies for washing compartments 23.5 etc. which follow in the direction of the arrow 24, the washing compartment 23.4. There again a normal countercurrent operation takes place.

The control of the various shut-off means in their open and closed position, depending on the prevailing load condition thereby constitutes no problem, because these means are controllable without difficulties by means of a from a programmed computer, whereby it is only necessary to indicate upon feeding the computer the kind of washing item involved.

Basically, nothing changes either, obviously, if several washing compartments 23 placed adjacent to each other or in spaced relation, contain colored laundry items, while the remaining washing compartments contain white wash or vice versa, because such a load condition merely is a question of the control of the shut-off means, whereby the principle according to the invention explained with reference to FIGS. 1, 1*a* and particularly 1*b*, as shown above, is maintained unchanged.

It is perfectly obvious that with the design according to FIG. 1, separately designed countercurrent conduits 10, the connecting conduit 12 and the conduit sections 11 connecting the connecting conduit 12 to the washing drum may partly coincide, as shown in FIG. 2, whereby then according to FIG. 2 the countercurrent conduits 10 in each case make use of one section of the connecting conduit, and the conduit sections connecting the washing drum 22 in each case with the connecting conduit 12 represent an additional section of the countercurrent conduit 10, the shut-off means 2 then in each case being arranged in said section.

FIG. 2*a* shows in a manner analogous with FIG. 1*a* the condition under pure countercurrent principle, whereby the washing drum 22 contains merely laundry of one single kind (for instance white wash). Then, according to FIG. 2*a* the shut-off means 3 located in the connecting conduit 12 are closed.

If, conversely, one washing compartment 23.3 contains multicolored laundry, as per FIG. 2*a*, the normal countercurrent operation from one washing compartment to the next one takes place only from the end of the washing drum only as far as the washing compartment 23.5, while the washing compartment containing colored laundry 23.3 again is sealed against its environment, as it has been explained already before with reference to FIG. 1*b*. The shut-off means 2.3 and 4.3 associated with the washing compartment 23.3 thus are closed, while the shut-off means 3.3 located between the shut-off means 2.3 and 4.3 in the connecting conduit 12 is opened, so that the countercurrent liquid can flow opposite the washing direction, according to arrow 24, from the washing compartment 23.4 through the opened shut-off means 4.4 via the connecting line 12, the shut-off means 3.3 located therein and opened, and the opened shut-off means 2.2, by-passing the washing compartment 23.3 and entering the washing compartment 23.2.

It also should be pointed out that the washing process in the countercurrent principle by no means is necessarily reserved to white wash, for example, while, for example, multicolored or woolen laundry items to be washed simultaneously are washed under the multi-lye method as it is explained in greater detail below, but for optimizing the profitability, the manner of operation appropriately is so provided that the kind of laundry present preponderantly is laundered under the countercurrent procedure, while laundry present to a lesser degree of the second kind is processed according to the multi-lye method.

FIG. 3 shows in a conduit diagram completed with respect to FIGS. 1 and 2, a continuous washing machine 20 designed as double drum machine, with the rotatable washing drum not being shown in FIG. 3, only its outer drum being represented schematically. It shall again be pointed out that the presentation in FIG. 3 more or less relates to a conduit circuit diagram, so that the arrangement of the conduits in relation to each other and to the drum, selected here for greater clarity, naturally does not correspond with the actual arrangement (for example in height).

The outer drum of the washing machine 20 has washing compartments A to K, whereby the laundry to be washed is fed item by item into the washing compartment A which thus represents the loading zone and jointly with the washing compartment B the soaking zone. The washing compartments C to G are washing compartments associated with the individual washing zones, while the washing compartments H to K represent the rinsing zone.

A feed conduit 13 is shown in the upper portion of FIG. 3, through which fresh water is directed into the washing compartment K of the rinsing zone. True, the feeding conduit 13 is continued as far as the washing compartment 13 and connected in each case with a conduit section 14 to each washing compartment C to K, with a shut-off means 6 being present in each conduit section 14, which may selectively be opened or closed.

A conduit 15 here designated as soaking conduit extends from the end of the washing drum 20 along the washing machine, forwardly to the first washing compartment A. A pump P is present in the soaking conduit 15, by means of which approximately 75% of the washing liquid added at the drum end are conveyed after leaving the rinsing zone, to the washing compartment A, while the remaining liquid—that is about 25%—travels through the washing machine 20 in countercurrent, that is opposite to the direction of travel of the laundry, according to the arrow 24, as will be explained below.

The outer drum of the washing machine 20 is connected on its bottom side with a so-called runoff tank 16, at which for the selective heating of certain washing compartments and/or washing zones, steam may be introduced, but this shall not be discussed in detail. A conduit section 11 provided with a controllable shut-off means 2 leads in each case from the runoff tanks 16 of the washing compartments C to G and the rinsing compartments H to K to a connecting conduit 12 already explained with reference to FIG. 1. Between the junctions of the conduit sections 11 into the connecting conduit 12, a controllable shut-off means 3 is arranged, according to FIG. 1 and/or 2.

So-called pulsators, as they are described in the German Display Copy No. 25 27 503, are located at one side of the washing machine. The pulsator of one washing compartment thus has an opening located above the normal washing liquid level at the circumference of the washing drum bottom in the direction of rotation, in an intermediate container provided with a countercurrent conduit 10 terminating in a washing compartment preceding the arrow 10, whereby each countercurrent conduit 10 is provided with a controllable shut-off means 4.

Moreover, a drain conduit 17 terminating into a drain channel 17' is present and connected to each washing compartment A to K via a line 18, in which in each case a controllable shut-off means 1 is placed. In each case overflow plugs 19 which are associated with the individual washing compartments are located in the discharge conduits in each case in the area of the washing compartments B to K.

A field is plotted beneath the washing machine 20 in FIG. 3 corresponding to the washing compartments A to K, which indicates whether white laundry or colored laundry is located in a washing compartment, whereby in the latter case the corresponding box is hatched.

In the condition according to FIG. 3 the washing machine 20 only contains laundry of one kind, namely white wash so that the usual countercurrent operation known per se from prior art can be applied.

In this case fresh water enters the washing machine 20 from a fresh water reservoir in the direction of the arrow 25, in fact via the shut-off means K6 of the conduit K14, thus entering the washing compartment K associated with the rinsing zone. All shut-off means 1, 2, 3, and 6, with the exception of the shut-off means K6 are closed and all shut-off means 4 in the countercurrent conduit 10 are opened. The remaining current not flowing as partial current through the washing machine 20 flows from the washing compartments H, I and K associated with the rinsing zone, via the overflow plugs 19 into the right portion of the discharge conduit 17 which is closed by a shut-off means 5 toward the channel 17', so that this liquid reaches the washing compartment A from the overflow plug 19 and a closed shut-off means 5' located in a connecting conduit between the discharge conduit 17 and the soaking conduit 15, and via the pump P.

Following the completion of the washing cycle the drum rotates about 360°, whereby each laundry batch enters the adjacent washing compartment in the direction of the arrow 24, along with the preponderant part of the washing fluid. At the same time the countercurrent liquid flows via the countercurrent conduits 10 and through the opened shut-off means 4 opposite to the arrow 24 into the adjacent laundry compartment, and so forth.

If according to FIG. 3*a* a batch of laundry consisting of colored material is placed into the washing compartment A, nothing changes during the washing phase with respect to the valve positions. A change only occurs in the conveying phase whereby the shut-off means located in conduit A18 is opened, in order to deliver the residual liquid possibly discolored by the colored laundry items into the discharge conduit 17 and thus to drain the washing compartment A for a new batch of laundry, possibly consisting of white material.

If the batch of colored laundry then reached the washing compartment B according to FIG. 3*c*, again no change occurs with respect to the position of the shut-off means against FIG. 3, because the compartment B used for the soaking is not connected to the first washing compartment C via a countercurrent conduit 10. During the conveying of the batch of colored laundry from the washing compartment B the shut-off means B1 is opened again according to the manner of operation according to FIG. 3*b*, to cause the residual liquid which remained after the conveying in washing compartment B to drain via the discharge conduit 17 into channel 17'. Normal countercurrent operation continues to take place at the residual section of the washing machine.

Once the colored laundry batch has arrived in the washing compartment C (FIG. 3*e*) in which a prewashing cycle takes place, the shut-off means C4 is closed to seal the washing compartment C against the adjacent washing compartment D, and during the subsequent conveying operation into the washing compartment D according to FIG. 3*f* the shut-off means C1 is opened again, so that the washing compartment C is connected to channel 17' via the drain conduit 17.

Then a bath change occurs in the washing compartment 3D according to FIG. 3*g*, whereby the shutoff means D1 is opened toward the drain conduit 17. Subsequently new washing liquid flows into the washing compartment D via the feed conduit 13 and the conduit section 14 connecting the feed conduit 13 to the washing compartment D, with the shut-off means D6 located in conduit D14 being opened. Instead, the new washing liquid can be fed into the washing compartment D also from a supply tank V via conduit 14, in which the liquid already can be preheated to 60° C. (140° F.) for example.

During the washing cycle, when the colored laundry is in the washing compartment D, according to FIG. 3*h* the shut-off means C4 in the countercurrent conduit D/C10 connecting the washing compartments D and C, as well as the shut-off means D4 in the countercurrent conduit E/D10 connecting the washing compartments E and D, are closed, while the shut-off means D3 in the connecting conduit 12 and the shut-off means E2 and C2 in the conduit sections E11 and C11 are opened, so that on the one hand the colored laundry located in the laundry compartment D is sealed against its environment, and on the other hand during the subsequent conveying operation according to FIG. 3*i* countercurrent liquid can flow from the washing compartment E into the washing compartment C, while by-passing the washing compartment D.

During the subsequent washing operation in the washing compartment E the control then is accomplished according as per FIG. 3*k*. Then, in addition to the shut-off means I2, the shut-off means E4 and D4 are closed, while the shut-off means F2, E3, D3 and D2 are opened, so that countercurrent liquid can flow from the washing compartment F into the washing compartment D, while by-passing the washing compartment E filled with colored laundry material. As can be seen from FIG. 3*k*, among other things, again a normal countercurrent operation takes place between the washing compartments D and C, via the opened shut-off means C4 and the countercurrent conduit D/C10. Once more it shall be pointed out here that in each case following the draining of the residual liquid from a washing compartment which contained colored laundry, this quasi lost liquid discharging via the drain conduit 17 into channel 17' can be equalized by a short-lived addition of fresh water via the feed line 13, when the shut-off means 6 associated with the corresponding washing compartment is opened for a brief time.

By the way, the shut-off means 6 are means which can be designed for example as double valves, whereby in the one valve the quantity flowing through is to be adjusted, while the other valve merely is controllable in open or closed position. As can be seen from FIG. 3-1 to 3-0, the circuits of the corresponding shut-off means then are corresponding in each case, that is in such a manner that a washing compartment containing colored laundry in each case is by-passed while maintaining the countercurrent operation via a "wandering by-pass" realized based on the control of the shut-off means. While the laundry batch containing colored laundry from the washing compartment G into the washing compartment H (FIG. 3*p*) the colored laundry batch reaches the rinsing zone, whereby the rinsing phase for the colored laundry then can be accomplished in the following overflow method.

The particular advantage of the invention resides in the fact that even with the simultaneous washing of laundry batches of different kinds in an economically desirable manner the countercurrent method, recognized universally as advantageous, can be applied, while laundry of the second kind can be washed simultaneously in the same machine, without causing any reciprocal negative influence, whereby the economically unfavorable washing method according to the multi-lye method is restricted to merely the laundry of the second kind present to a lesser degree.

The additional investment to be realized for this is limited to various conduits and shut-off means and to a control system for the shut-off means which is controlled by a programmed computer, such shut-off means being present on account of the necessary washing programs as basic equipment in any continuous washing machine and requiring on the whole investments which cannot be compared either the otherwise necessary investment costs for a second washing machines, or in the long run with the loss of profitability in the execution of the multi-lye method for all laundry batches.

I claim:

1. A continuous washing machine for the washing of laundry batches of, for example, white and colored laundry items, comprising a washing drum which has a longitudinal axis, a loading end and a discharge end, and contains a washing liquid and is propellable about its longitudinal axis and has laundry compartments which are substantially separated from each other with respect to said washing liquid, each of said compartments being connected to an adjacent laundry compartment by a countercurrent conduit and laundry items being transported from one of said compartments to the next, whereby during the transporting of the laundry items from one laundry compartment to the next one a partial current of liquid supplied to the laundry compartment located adjacent the discharge end of the washing drum is conducted in countercurrent to the laundry supplied batchwise at said loading end of the drum, said laundry traversing the laundry compartments cyclically and consecutively through the washing machine, said liquid countercurrent being a part of a liquid fed into the washing machine at the discharge end of the drum via a feed conduit, said drum further including a rinsing zone located at the discharge end and a loading and soaking zone located at the loading end, and said washing machine further comprising a soaking conduit through which the remainder of the liquid supplied at the drum discharge end which is not conducted via said countercurrent conduit is to be conducted from said rinsing zone located at the drum discharge end to said loading and soaking zone located at the loading end of the washing drum, each of said countercurrent conduits being provided with a shut-off means which can be selectively opened and closed; each of the washing compartments moreover being connected via a conduit section having a correspondingly controllable shut-off means to a joint connective conduit which in each case is provided between said conduit sections of two adjacent compartments with a correspondingly controllable shut-off means; and a program-controlled control installation connected to the shut-off means for opening and/or closing in such a manner that the countercurrent liquid is to be conducted around at least one of said washing compartments and no liquid enters another washing compartment from this bypassed washing compartment.

2. The washing machine as defined claim 1, wherein said washing compartments are connected in each case via a conduit containing a shut-off means controllable with respect to its opening and closing condition, to a drain conduit.

3. The washing machine as defined in claim 2, wherein said washing compartments are connected in each case via an overflow to a drain conduit.

4. The washing machine as defined in claim 2 or 3, wherein said drain conduit at its end facing away from the drain is connected to the soaking conduit via a controllable shut-off means.

5. The washing machine as defined in claim 1 or 2 or 3, wherein said washing compartments are connected in each case with the feed conduit via a conduit containing a shut-off means controllable with respect to its open and closed condition.

6. The washing machine as defined in claim 5, wherein said shut-off means in the conduits connecting the feed conduit to the washing compartments are so designed that flowthrough is adjustable in the open position.

* * * * *